US005209792A

United States Patent [19]

Besch et al.

[11] Patent Number: 5,209,792

[45] Date of Patent: May 11, 1993

[54] HIGH-STRENGTH, DAMAGE-RESISTANT RAIL

[75] Inventors: Gordon O. Besch, Lenexa; John A. Hovland, Overland Park, both of Kans.; Jun Furukawa, Yokohama, Japan; Hideyuki Yamanaka, Hiroshima, Japan; Kozo Fukuda, Miyagi, Japan; Tomoo Horita, Hiroshima, Japan; Yuzuru Kataoka, Hiroshima, Japan; Masahiro Ueda, Hiroshima, Japan; Tetsunari Ide, Hiroshima, Japan; Atsushi Ito, Yokohama, Japan; Takao Gino, Kanagawa, Japan

[73] Assignees: NKK Corporation, Japan; Burlington Northern Railroad Company, Fort Worth, Tex.

[21] Appl. No.: 866,129

[22] Filed: Apr. 7, 1992

Related U.S. Application Data

[63] Continuation of Ser. No. 559,628, Jul. 30, 1990, abandoned.

[51] Int. Cl.[5] ..... C21D 1/18

[52] U.S. Cl. ..... 148/581; 148/660; 148/320; 148/333; 148/334; 148/335; 148/336

[58] Field of Search ..... 148/320, 333, 334, 335, 148/336, 581, 660

[56] References Cited

U.S. PATENT DOCUMENTS

| | | | |
|---|---|---|---|
| 4,575,397 | 3/1986 | Heller | 148/148 |
| 4,767,475 | 8/1988 | Fukuda et al. | 148/333 |
| 4,913,747 | 4/1990 | Fukuda et al. | 148/128 |

FOREIGN PATENT DOCUMENTS

| | | |
|---|---|---|
| 0186373 | 7/1986 | European Pat. Off. . |
| 0358362 | 3/1990 | European Pat. Off. . |
| 765157 | 6/1934 | France . |
| 62-244136 | 9/1987 | Japan . |
| 62-244137 | 9/1987 | Japan . |
| 64-87719 | 3/1989 | Japan . |
| 2-282448 | 11/1990 | Japan . |
| 619699 | 3/1949 | United Kingdom . |
| 2118579A | 11/1983 | United Kingdom . |

OTHER PUBLICATIONS

Davis, H. E., Troxell, G. E., and Wiskocil, C. T., The Testing and Inspection of Engineering Materials, Third Edition, McGraw-Hill Book Company, 1964, pp. 211-212.

*Primary Examiner*—R. Dean
*Assistant Examiner*—Sikyin Ip
*Attorney, Agent, or Firm*—Merchant, Gould, Smith, Edell, Welter & Schmidt

[57] ABSTRACT

A high-strength, damage-resistant rail characterized by essentially consists of 0.60 to 0.85 wt. % of C, 0.1 to 1.0 wt. % of Si, 0.5 to 1.5 wt. % of Mn, not more than 0.035 wt. % of P, not more than 0.040 wt. % of S, and not more than 0.05 wt. % of Al, a balance being Fe and indispensable impurity. The rail comprises corner and head side portions having a Brinell hardness $H_B$ of 341 to 405 and a head top portion having a hardness which is not more than 0.9 of the Brinell hardness of the corner and head side portions.

4 Claims, 8 Drawing Sheets

$$\text{HARDNESS RATIO} = \left(\frac{\text{HARDNESS OF RAIL HEAD TOP PORTION}}{\text{HARDNESS OF RAIL CORNER PORTION}}\right)$$

$$\text{HARDNESS RATIO} = \left( \frac{\text{HARDNESS OF RAIL HEAD TOP PORTION}}{\text{HARDNESS OF RAIL CORNER PORTION}} \right)$$

$$\text{HARDNESS RATIO} = \left( \frac{\text{HARDNESS OF RAIL HEAD TOP PORTION}}{\text{HARDNESS OF RAIL CORNER PORTION}} \right)$$

HIGH-STRENGTH, DAMAGE-RESISTANT RAIL

This is a continuation of application Ser. No. 07/559,628, filed Jul. 30, 1990, which was abandoned upon the filing hereof.

BACKGROUND OF THE INVENTION

1. Field of the Invention

The present invention relates to an anti-wear, high-strength, damage-resistant rail used for sharp curves of a high-axle load railroad having a highly rigid track and, more particularly, to a high-strength, damage-resistant rail of which a fitting property to wheels during an initial period of use of the rail can be improved, and resistance to damage to a head top portion can be improved.

2. Description of the Related Art

A head of a rail has a head top portion, corner portions, head side portions, and jaws. A conventional anti-wear, high-strength rail used in a track of sharp curves of a high-axle load railroad which uses wooden crossties is heat-treated such that the hardness of the corner and head side portions is equal to that of the head top portion. Therefore, the anti-wear properties of the rail corner portions are the same as those of the rail head top portion.

However, contact between the wheels and the rails is complicated, and the contact pressures vary depending on the position of the rail head-wheel contact. In a sharp curve of a high-axle load railroad, large slip forces act on a rail gauge corner portion (i.e., an inner corner portion) and rail head side surfaces. However, large contact pressures act on the rail head top portion and the rail gauge corner portion. As a result, the rail gauge corner portion and the rail head side portions of the conventional anti-wear, high-strength rail are worn much more than the rail head top portion. Therefore, the rail head top portion is always worn much less than the rail gauge corner portion, and a maximum contact pressure from each wheel acts on the central less-worn portion of the rail head top portion.

Since the contact state between the wheels and the conventional anti-wear, high-strength rail having uniform wear properties of the rail head is as described above, it takes a long period of time to fit wheels to the rail during an initial period of use of the rails. A local excessive contact stress lasts for a long period of time, and defects caused by fatigue tend to be formed. Even after the wheels are brought into satisfactory fitness to the new rails, a maximum contact pressure acts on the rail head top portion of each rail. Decisive problems are not posed in this condition when wooden crossties are used to form a track. However, when concrete crossties are used to form a highly rigid track, an impactive maximum contact pressure generated upon passing of a rolling stock is increased. Therefore, damage called the surface contact fatigue (crack) typically occurs in the central rail head top portion.

In order to prevent the head check according to a conventional technique, a method of grinding and correcting a rail head surface layer prior to accumulation of fatigue in the rails is employed. However, this operation is time-consuming and costly. In addition, it is also difficult to determine an optimal grinding/correcting time.

SUMMARY OF THE INVENTION

The present invention has been made in consideration of the above situation, and has as its object to provide a high-strength, damage-resistant rail wherein a maximum contact pressure acting on a central rail head top portion can be reduced without reducing the wheel-loads of rolling stocks, the fatigue is not accumulated in the central rail head top portion without grinding and correcting the rails, a high resistance to contact fatigue and a high resistance to damage can be obtained, and the wheels can be brought into satisfactory rolling contact with new rails in the initial period of use of them.

According to an aspect of the present invention, there is provided a high-strength, damage-resistant rail characterized by essentially consisting of 0.60 to 0.85 wt. % of C, 0.1 to 1.0 wt. % of Si, 0.5 to 1.5 wt. % of Mn, not more than 0.035 wt. % of P, not more than 0.040 wt. % of S, and not more than 0.05 wt. % of Al, a balance being Fe and indispensable impurity, and comprising corner and head side portions having a Brinell hardness $H_B$ of 341 to 405 and a head top portion having a hardness which is not more than 0.9 of the Brinell hardness of the corner and head side portions.

According to another aspect of the present invention, there is provided a high-strength, damage-resistant rail characterized by essentially consisting of 0.60 to 0.85 wt. % of C, 0.1 to 1.0 wt. % of Si, 0.5 to 1.5 wt. % of Mn, not more than 0.035 wt. % of P, not more than 0.040 wt. % of S, not more than 0.05 wt. % of Al, at least one element selected group consisting of 0.05 to 1.5 wt. % of Cr, 0.01 to 0.20 wt. % of Mo, 0.01 to 0.10 wt. % of V, 0.1 to 1.0 wt. % of Ni, and 0.005 to 0.050 wt. % of Nb, a balance being Fe and indispensable impurities, and comprising corner and head side portions having a Brinell hardness $H_B$ of 341 to 405 and a head top portion having a hardness which is not more than 0.9 of the Brinell hardness of the corner and head side portions.

In this high-strength, damage-resistant rail, its head top portion has improved fitting property to the wheels during initial period of use of the rail, and the resistance to damage to its head top portion used along a highly rigid track can be improved.

According to still another aspect of the present invention, there is provided a method for manufacturing a high-strength, damage-resistant rail, comprising the steps of preparing a rail stock essentially consisting of 0.60 to 0.85 wt. % of C, 0.1 to 1.0 wt. % of Si, 0.5 to 1.5 wt. % of Mn, not more than 0.035 wt. % of P, not more than 0.040 wt. % of S, not more than 0.05 wt. % of Al, and a balance being Fe and indispensable impurities by hot rolling, and cooling the head of the rail stock by supplying a coolant from nozzles of a cooling header to the head of the rail stock in a state where the head of the rail stock maintains an austenite temperature, the cooling step being carried out such that the cooling speed of the top head portion of the rail stock is lower than that of the side head portions of the rail stock by adjusting at least one of: the number of nozzles provided for the cooling header; the diameter of the nozzles; and the coolant supply pressure.

According to still another aspect of the present invention, there is provided a method for manufacturing a high-strength, damage-resistant rail, comprising the steps of preparing a rail stock essentially consisting of 0.60 to 0.85 wt. % of C; 0.1 to 1.0 wt. % of Si; 0.5 to 1.5 wt. % of Mn; not more than 0.035 wt. % of P; not more than 0.040 wt. % of S; not more than 0.05 wt. % of Al; at least one of 0.05 to 1.5 wt. % of Cr, 0.01 to 0.20 wt. % of Mo, 0.01 to 0.10 wt. % of V, 0.1 to 1.0 wt. % of Ni, and 0.005 to 0.050 wt. % of Nb; and a balance being Fe and indispensable impurities by hot rolling, and cooling the head of the rail stock by supplying a coolant from nozzles of a cooling header to the rail stock in a state where the head of the rail stock maintains an austenite temperature, the cooling step being carried out such that the cooling speed of the top head portion of the head of the rail stock is lower than that of the head side portions of the rail stock by adjusting at least one of: the number of nozzles provided for the cooling header; the diameter of the nozzles; and the coolant supply pressure.

According to still another aspect of the present invention, there is provided a method for controlling the cooling of a rail, comprising the steps of maintaining a rail stock at an austenite temperature, and cooling the head of the rail stock by supplying a coolant from nozzles of a cooling header to the rail stock while adjusting at least one of: the number of nozzles provided for the cooling header; the diameter of the nozzles; and the coolant supply pressure, such that the cooling speed of the top head portion of the rail stock is lower than that of the head side portions of the rail stock.

DETAILED DESCRIPTION OF THE PREFERRED EMBODIMENTS

The present invention will be described in detail below.

Figure 1:
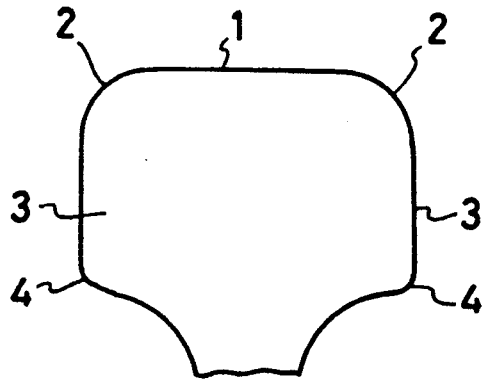
FIG. 1 is a sectional view showing a rail head according to the present invention.

FIG. 1 is a sectional view showing a head of a high-strength, damage-resistant rail according to the present invention. The rail head comprises a head top portion 1, corner portions 2, head side portions 3, and jaw portions 4. One of the corner portions 2 serves as a gauge corner portion which is brought into contact with each wheel during use of the rail.

Figure 2:
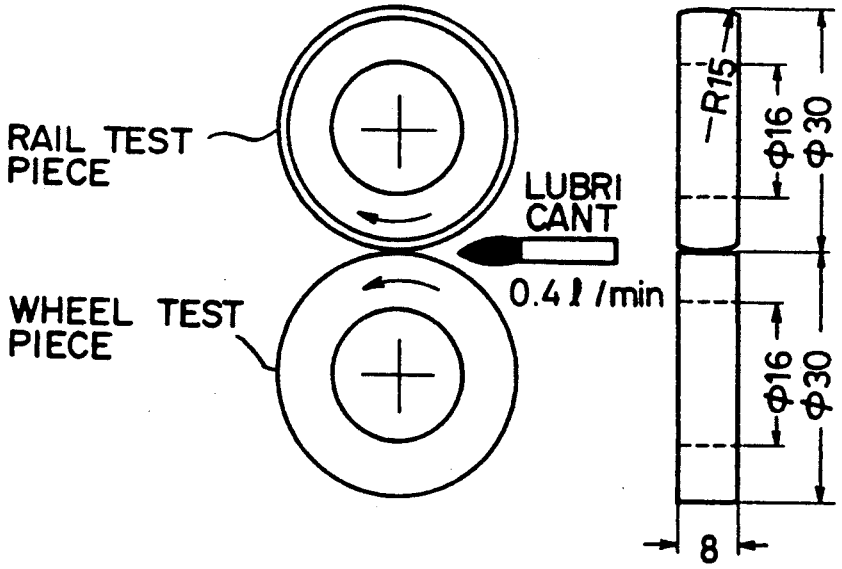
FIG. 2 is a view for explaining the 2-cylinder rolling contact test to help understanding the relationship between the damage life and the vertical load acting on the rail.
Figure 3:
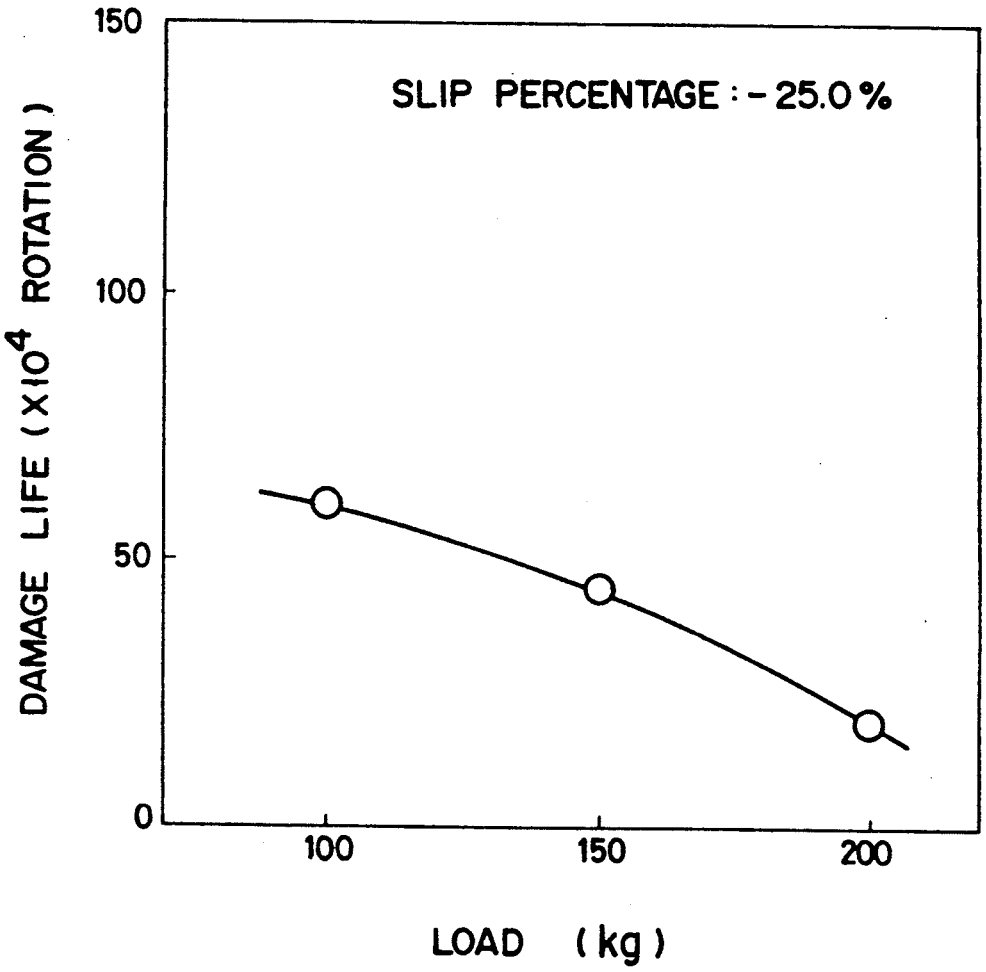
FIG. 3 is a graph showing the damage life as a function of the vertical load in the test shown in FIG. 2.

Damage to the rail, especially, the head check to the head top portion 1 occurs within a short period of time when a contact stress acting on the rail head is increased. This will be described with reference to FIGS. 2 and 3. FIG. 2 is an illustration showing a 2-cylinder rolling contact fatigue test using a rail test piece having a contact radius of curvature of 15 mm and a maximum diameter of 30 mm and a wheel test piece having a diameter of 30 mm. A relationship between a vertical load and a damage life is obtained, as shown in FIG. 3. When a vertical load is large, i.e., when a contact stress is large, it can be confirmed that damage occurs within a short period of time (i.e., the damage life is short).

When the wheel is brought into unsatisfactory rolling contact with a new high-strength rail in the initial period of use, a vertical load is concentrated on the rail, and damage tends to occur in the rail. When a rail portion which is brought into contact with a wheel has a shape, due to wear, which allows satisfactory fitness to the wheel, a vertical stress acts on a wider portion of the rail reducing surface contact stress resulting in a wear rate. Judging from the above facts, in order to prolong the rail life, it is effective to disperse a maximum vertical stress acting severely on the conventional rail head top surface. This stress acts on the surface due to a lower wear rate.

In order to retard the head check of the head top portion 1, a load acting on the rail is reduced, or a contact pressure from a wheel is controlled not to be concentrated on a specific rail portion.

The present invention employs the latter method to solve the conventional problem without reducing the wheelloads of rolling stocks. More specifically, while the strength for supporting railcars and anti-wear property are maintained, a rail composition is controlled to reduce the maximum contact stress acting on the rail head top portion. At the same time, the hardness of the corner and head side portions of the rail is set to be higher than that of the head top portion.

The rail composition according to the present invention is limited due to the following reasons.

The content of C falls within the range of 0.60 to 0.85 wt. %. When the content of C is 0.6 wt. % or more, a high strength and an excellent anti-wear property can be expected. However, when the content of C exceeds 0.85 wt. %, precipitation of the primary cementite causes degradation of toughness.

The content of Si falls within the range of 0.1 to 1.0 wt. %. The content of Si must be at least 0.1% to assure the rail strength. However, when the content exceeds 1.0%, toughness and weldability are degraded.

The content of Mn falls within the range of 0.5 to 1.5 wt. %. The content of Mn must be at least 0.5 wt. % to assure the rail strength. However, when the content exceeds 1.5%, toughness and weldability are degraded.

The content of P is 0.035 wt. % or less and of S is 0.040 wt. % or less to prevent degradation of ductility.

The upper limit of the content of Al is 0.05 wt. % since aluminum is a component which degrades the fatigue property.

As for rails used under severe conditions for contact between rails and wheels, at least one of Cr, Mo, V, Ni, and Nb is added in the form of a low-alloy.

The content of Cr falls within the range of 0.05 to 1.50 wt. %. When the content is 0.5 wt. % or more, the interlamellar spacing of pearlite can be reduced to obtain a fine pearlite, thereby improving an anti-wear property and resistance to damage. However, when the content exceeds 1.50 wt. %, weldability is degraded.

The content of Mo falls within the range of 0.01 to 0.2 wt. %. Mo is an element for increasing the strength as in Cr. This effect is exhibited when its content is 0.01% or more. However, when the content exceeds 0.2% wt. %, weldability is degraded.

Nb and V are elements for precipitation hardening. The contents of Nb and V fall within the ranges of 0.005 to 0.050 wt. % and 0.01 to 0.10 wt. %, respectively. In order to obtain an effect as precipitation hardening elements, the content of Nb is 0.005 wt. % or more, and the content of V is 0.01% or more. However, when the contents of Nb and V exceed 0.05 wt. % and 0.10 wt. %, respectively, a coarse Nb or V carbonitride is precipitated to degrade toughness of the rail.

Ni is an element for improving the strength and toughness. The content of Ni falls within the range of 0.1 to 1.0 wt. %. If the content is less than 0.1 wt. %, no good effect is exhibited. However, the effect is saturated when the content is 1.0 wt. %.

The rail according to the present invention has the component composition described above and has a fine pearlitic structure. As described above, according to the present invention, the hardness distribution of the rail head is adjusted to control the anti-wear properties of the respective portions of the rail. The maximum contact pressure level is lowered, and head check damage to the rail heat top portion which is caused by a high contact pressure in a highly rigid track can be suppressed. A preferable hardness distribution can be achieved by adjusting a heat treatment of each portion.

Figure 4:
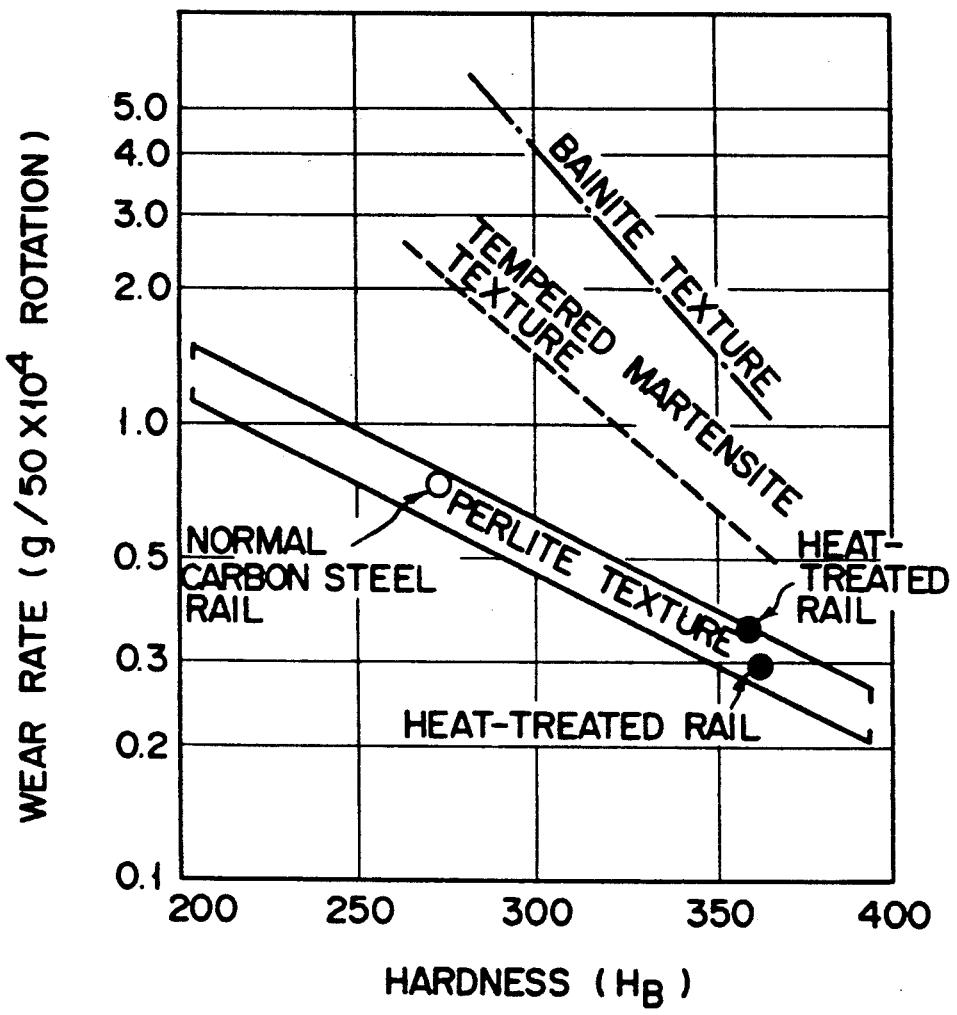
FIG. 4 is a graph showing the wear rate as a function of hardness in the 2-cylinder rolling contact wear test.

The same effect as described above can be obtained even if a metallurgical structure of the head top portion is changed to adjust a wear rate. More specifically, according to the present invention, the hardness distribution of the rail is adjusted by an appropriate treatment under the assumption of a fine pearlitic structure. However, by changing the metallurgical structure, the anti-wear property can be controlled regardless its hardness. For example, as shown in FIG. 4, when the hardness value is kept unchanged, the fine pearlitic structure has the best anti-wear property. As shown in FIG. 4, it is possible to increase a wear rate while the hardness is increased to improve the fatigue strength upon control of the metallurgical structure.

Figure 5:
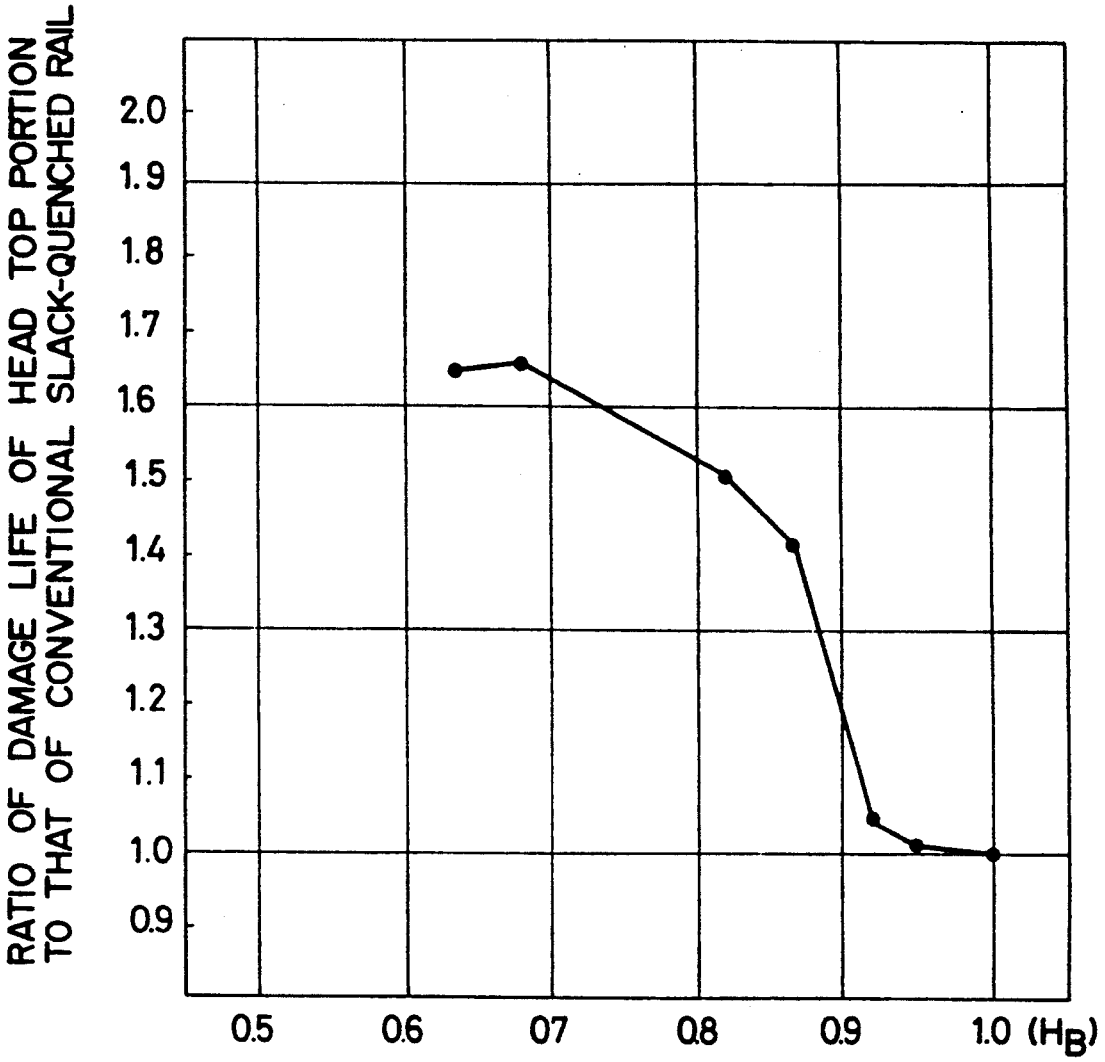
FIG. 5 is a graph showing the damage life as a function of the hardness ratio of the rail head top portion to the rail corner portion.

A hardness ratio of the head top portion and the corner and head side portions in a rail having the fine pearlitic structure to obtain practically the effect described above will be described below. As described above, in order to control a contact condition so that the contact pressure from a wheel is not locally concentrated, the hardness of the rail head top portion is set to be lower than that of the rail corner and head side portions. Preferable hardness ratios were checked in a damage life test using a 2-cylinder rolling contact test machine. This test was conducted by using cylindrical test pieces having a sectional size which was ¼ that of a real wheel and a real rail, respectively. The hardness value of the wheel test piece was set to about $H_B$ (Brinell hardness) 331. The rail test pieces were sampled from a C-Mn steel (0.77 wt. % of C, 0.23 wt. % of Si, 0.90 wt. % of Mn, 0.019 wt. % of P, 0.008 wt. % of S, and 0.04 wt. % of sol. Al). Portions corresponding to the head were heat-treated to set a hardness value of portions corresponding to the rail corner portions to be about $H_B$ 370. The hardness of the head top portions was lowered to set hardness differences. Test results are shown in FIG. 5. The hardness ratios (Brinell hardness) between the hardness values of the portions corresponding to the head top portions to those of the portions corresponding to the corner portions are plotted along the abscissa of the graph. Ratios of life cycles of the head top portions of the rail test pieces of the present invention to that of the conventional anti-wear, high-strength rail (slack-quenched rail) are plotted along the ordinate. When the ratio of the hardness value of the portion corresponding to the head top portion to that of the portion corresponding to the corner portion was set to be 0.9 or less, it was confirmed that damage to the portion corresponding to the head top portion was greatly decreased. It was also confirmed that the fitness between the head portion of the rail and the wheel was accelerated in this range in the initial period of use of the rail. Therefore the ratio of the hardness value of the rail head top portion to that of the rail corner and head side portions is set to be 0.9 or less. When the hardness ratio was 0.6 or less, it was confirmed that the portion corresponding to the gauge corner portion was considerably damaged. Therefore, the hardness ratio is preferably 0.6 or more.

In order to obtain satisfactory values of the rail strength and the anti-wear property, the hardness value of the rail corner and head side portions falls within the range of $H_B$ 341 to $H_B$ 405.

Figure 6:
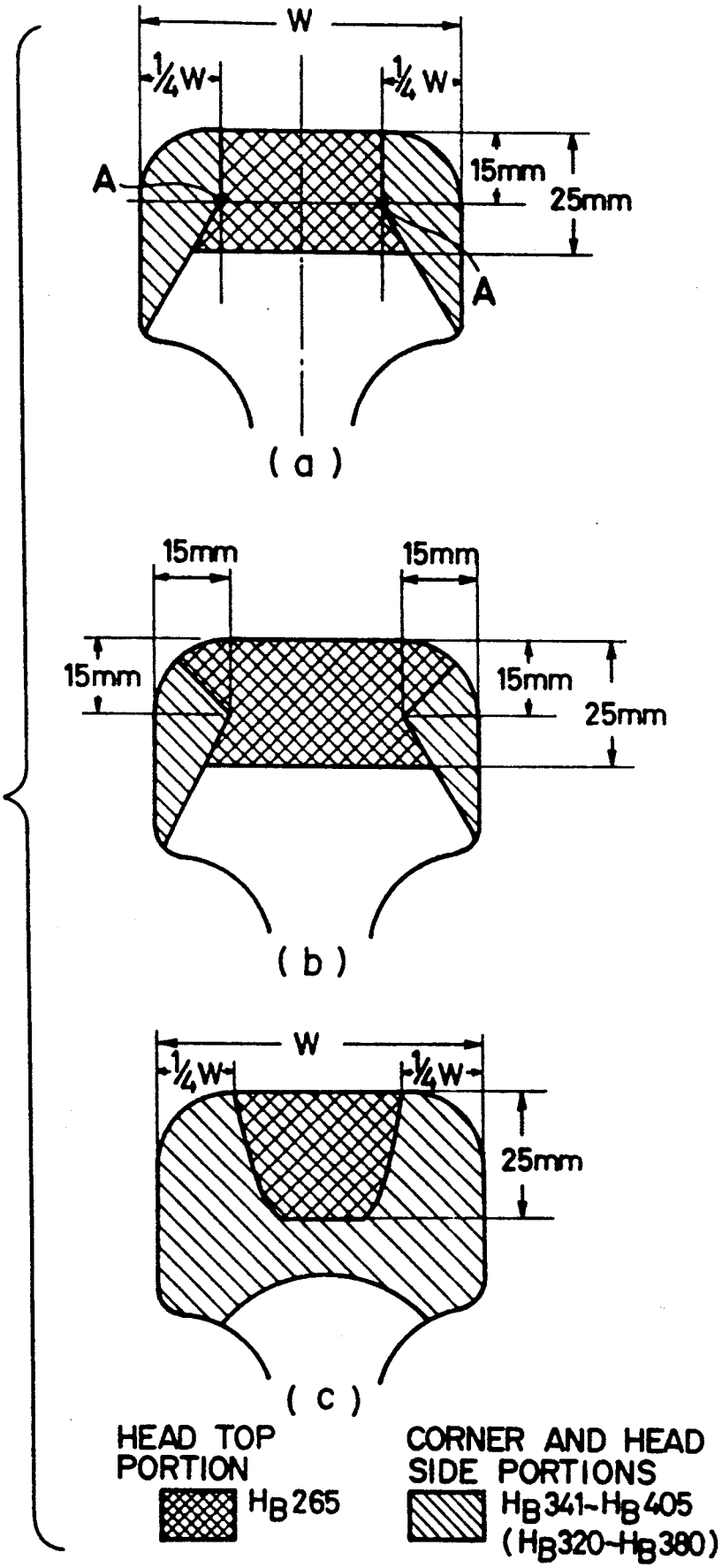
FIG. 6 is views showing hardness distributions of rails according to the present invention.

Hardness distributions of the head of the high-strength, damage-resistant rail are shown in FIG. 6. In (a) of FIG. 6, of portions from the rail head side surfaces to a depth of ¼ the rail head width, the rail corner and rail head side portions are defined by a portion from the rail head top surface to a depth of 15 mm and portions surrounded by the rail head side surfaces and lines connecting from points A and A' to the corresponding jaws. The hardness value of these portions falls within the range of $H_B$ 341 to $H_B$ 405 so as to provide an anti-wear property of a normal high-strength rail. The hardness value of the portion as a rail head top portion from the rail head top surface to a depth of 25 mm is set to be 0.9 or less but 0.6 or more of the hardness value of the rail corner and rail head side portions. At the same time, the hardness value of the head top portion is $H_B$ 265 or more. Therefore, a difference between the anti-wear properties of the head top portion and the gauge corner portion can be generated. The difference is set to be an optimal value in accordance with actual conditions of use of various types of rails. Therefore, problem caused by the excessive maximum contact pressure acting on the center of the rail head top portion can be solved.

In (b) of FIG. 6, the hardness value of the portions surrounded by portions defined by connecting a start point (this point is located at a depth of 15 mm from the rail head top surface and at a depth of 15 mm from the rail head side surfaces), the rail corner portions, and the jaws is set to be $H_B$ 341 to $H_B$ 405. The hardness value of the remaining portion starting from the rail head top portion to a depth of 25 mm is set to be 0.9 or less and 0.6 or more of the hardness of the above portions (i.e., the hardness value of $H_B$ 341 to $H_B$ 405). This hardness pattern provides the same effect as in (a) of FIG. 6.

Under a moderate condition of contact between the wheel and the rail as in a moderate curve, the hardness value of the high-strength portions of the head side and gauge corner portions can fall within the range of $H_B$ 320 to $H_B$ 380. As shown in (c) of FIG. 6, when a rail which has an upper central portion starting from the head top surface to a depth of about 25 mm and having a ½ width of the central rail head top portion has the above hardness range, this rail can be incorporated in the scope of the present invention, thereby obtaining the same effect as described above.

Since the hardness distribution of the rail head is adjusted such that a wear rate of the head top portion is slightly higher than that of the corner and head side portions in the initial period of use of the rail, the fitness between the head portion of the rail and the wheel was accelerated, and a local excessive contact stress can be eliminated. After the fitting process is finished, the wear rates of the respective head portions are adjusted under a condition of contact between the rails and the wheels, and the central head top portion is preferentially worn. Therefore, a vertical load acting on the rail head can be uniformly shared on the upper surface of the rail surface. An amplitude of stress acting on the rail head top portion can be suppressed, and the maximum contact pressure can be reduced to a level lower than the fatigue limit. Therefore, fatigue damage can be suppressed, and the rail life can be prolonged.

Next, a description will be given as to how the above-mentioned rail is manufactured.

In general, a rail is manufactured as follows. First, a rail stock is prepared by hot rolling. Next, the head of the rail stock is cooled from an austenite temperature. At the time, the cooling speed is controlled such that the resultant rail had different degree of hardness between the head top portion and the head side portions.

Figure 10:
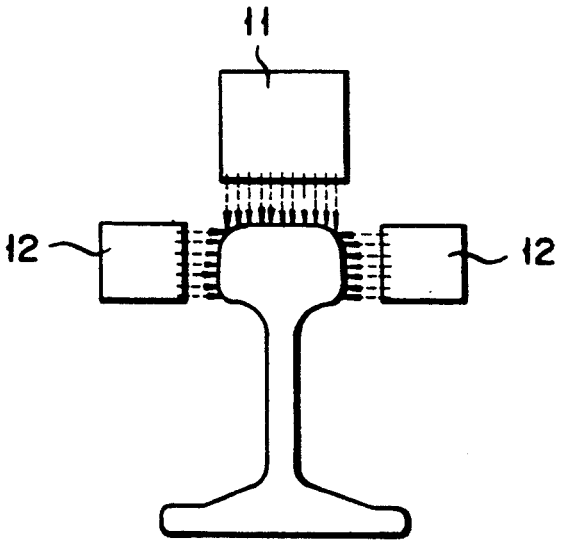
FIG. 10 is a view illustrating how a rail stock is cooled.

As shown in FIG. 10, the head of the rail stock is cooled by use of one head top portion-cooling header 11, and two head side portion-cooling headers 12. The head top portion-cooling header 11 is placed in opposition to the head top portion, and the head side portion-cooling headers 12 are placed in opposition to the head side portions, respectively. Each of the cooling heads has a plurality of nozzles, and a coolant (e.g. air) is supplied from the nozzles to the rail stock. The cooling temperature can be controlled in accordance with the portions of the rail head, by adjusting one of the number of nozzles, the diameter of the nozzles, and the coolant supply pressure. It should be noted that the hardness of the rail decreases more as the rail stock is cooled from the austenite temperature more slowly.

According to the present invention, a rail stock having a composition falling within the range prescribed in the present invention is manufactured by hot rolling. The head of the rail stock is cooled from an austenite temperature by supplying a coolant from cooling headers to the head. At the time, at least one of the number of nozzles, the diameter of nozzles and the coolant supply pressure is adjusted such that the cooling speed of the head top portion is lower than that of the head side portions. In the resultant rail, therefore, the head top portion has hardness lower than that of the head side portions.

If the rail stock maintains the austenite temperature after the hot rolling, it is cooled as it is. However, if the rail stock has a temperature lower than the austenite temperature after the hot rolling, then it is heated again to the austenite temperature.

EXAMPLES

The present invention will be described by way of its examples.

Steel rail materials (Table 1) having compositions falling within the limit of the present invention were used as rail elements.

TABLE 1

| | C—Mn steel | Cr—V steel | Cr—Mo—V steel | Ni—Nb steel |
|---|---|---|---|---|
| Chemical Compositions (wt. %) | | | | |
| C | 0.77 | 0.76 | 0.76 | 0.77 |
| Si | 0.23 | 0.23 | 0.23 | 0.22 |
| Mn | 0.90 | 0.91 | 0.90 | 0.90 |
| P | 0.019 | 0.019 | 0.019 | 0.015 |
| S | 0.008 | 0.008 | 0.008 | 0.009 |
| Ni | — | — | — | 0.24 |
| Cr | — | 0.30 | 0.16 | — |
| Mo | — | — | 0.08 | — |
| Nb | — | — | — | 0.020 |
| V | — | 0.04 | 0.02 | — |
| sol. Al | 0.004 | 0.003 | 0.002 | 0.004 |
| Fe | balance | balance | balance | balance |

A 60-kg rail sample formed of the C-Mn steel in Table 1 was used to prepare a conventional hard head rail obtained by slack-quenching the head, and a rail obtained by special slack-quenching in which head cooling was weakened according to the present invention were prepared.

Figure 11:
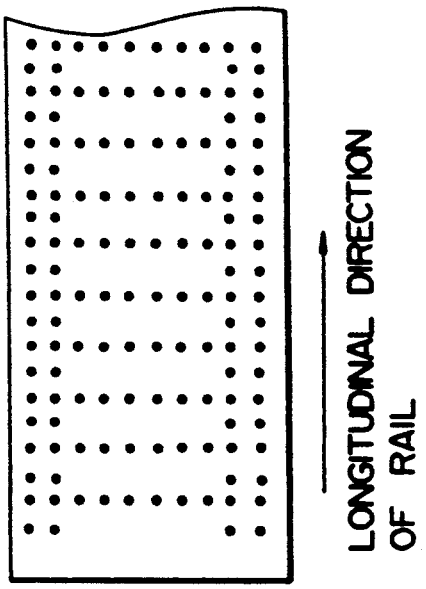
FIG. 11 is a view showing how nozzle holes are arranged in the head top portion-cooling head used in the method of the present invention.
Figure 12:
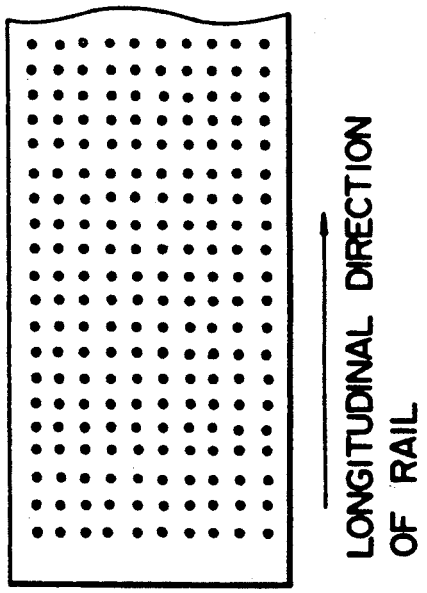
PRIOR ART FIG. 12
FIG. 12 is a view showing how nozzle holes are arranged in a head top portion-cooling head used in the prior art.

A rail according to the present invention was manufactured as follows. After a rail stock was prepared by hot rolling, by use of air headers 11 and 12 arranged in the manner shown in FIG. 10, air was supplied from the nozzles of the air headers 11 and 12 to the head of the rail stock which was in $Ar_1$ temperature or higher, so as to cool the rail stock. Air header 11 was adapted to cool the head top portion, while air headers 12 were adapted to cool the head side portions. FIG. 11 shows the arrangement of the nozzle holes formed in the head top portion-cooling air header 11. As is shown in FIG. 11, the header 11 employed in the present invention has a smaller number of nozzle holes in the central portion than in the other portions, whereas, a head top portion-cooling header employed in the prior art has uniformly-distributed nozzle holes, as is shown in FIG. 12. In the present invention, therefore, the amount of air supplied to the head top portion was reduced by providing a small number of nozzle holes in the central portion of the header 11. In addition, the air supply pressure of the headers was controlled, such that the pressure of the air supplied to the head top portion was lower than the pressure of the air supplied to the head side portions. For comparison between the present invention and the prior art, Table 2 below shows the air supply pressures used for the head top portion and head side portions and the ratio of the number of nozzle holes used for the head top portion to the number of nozzle holes used for the head side portions.

TABLE 2

| | Air Pressure [kgf/cm²] | | Ratio of Nozzle Hole Numbers | |
|---|---|---|---|---|
| | Head Top Portion | Head Side Portion | Head Top Portion | Head Side Portion |
| Present Invention | 0.8 | 2.9 | 0.7 | 1 |
| Conventional | 2.2 | 2.2 | 1 | 1 |

TABLE 2-continued

| | Air Pressure [kgf/cm²] | | Ratio of Nozzle Hole Numbers | |
|---|---|---|---|---|
| | Head Top Portion | Head Side Portion | Head Top Portion | Head Side Portion |
| Method | | | | |

Figure 7:
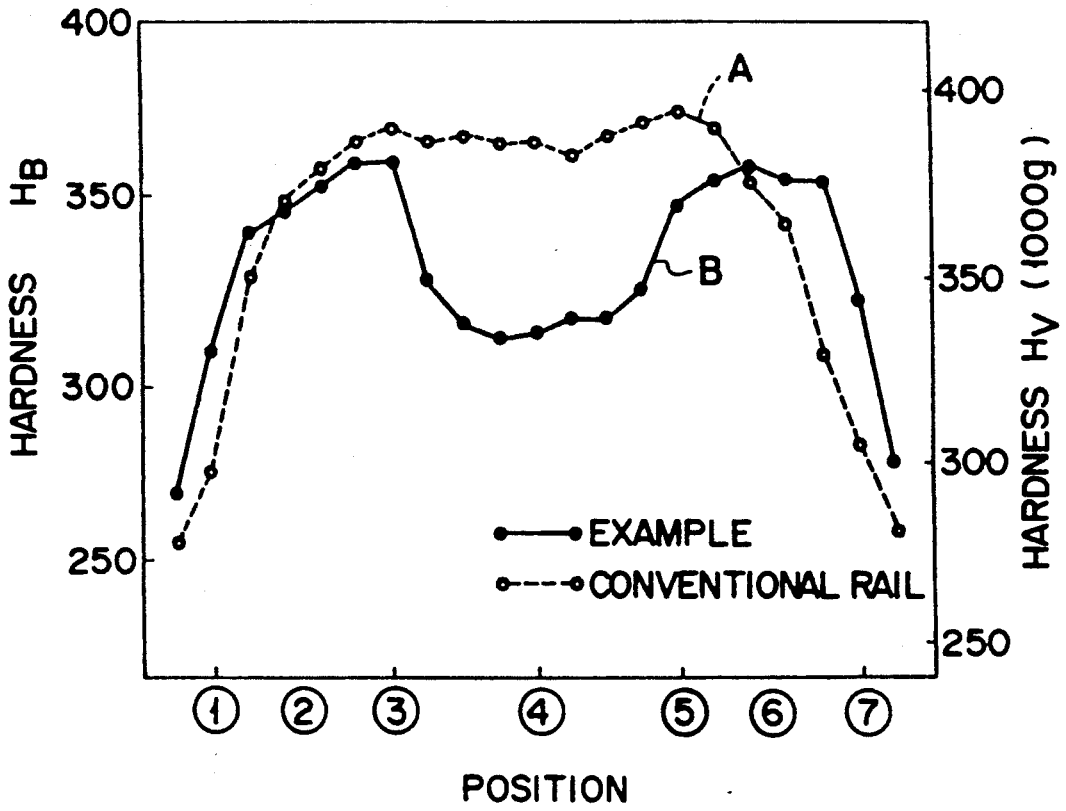
FIG. 7 is a graph showing hardness distributions of the rail heads.
Figure 8:
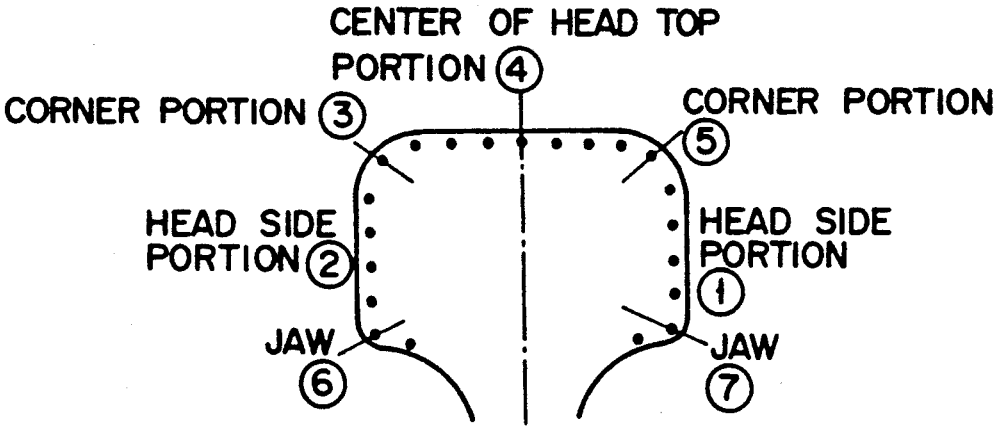
FIG. 8 is a view showing measurement points of the hardness distributions shown in FIG. 7.

The hardness distributions of portions at a depth of 1 mm from the rail head top portions of the rail samples are shown in FIG. 7. Reference symbol A in FIG. 7 represents a hardness distribution of the conventional rail; and B, a hardness distribution of the rail of the present invention. Encircled numbers plotted along the abscissa in FIG. 7 respectively correspond to encircled numbers representing actual hardness measurement points in FIG. 8.

As shown in FIG. 7, a difference between the hardness of the head top portion and the hardness of the head side and corner portions of the conventional rail is small. However, the hardness of the head top portion of the rail of the present invention is lowered.

Cylindrical test pieces each having a ¼ sectional size of a real wheel and a real rail, respectively were prepared from the rail materials having compositions shown in Table 1, and a damage life test was conducted by using a 2-cylinder rolling contact test machine. The hardness value of the wheel test piece was about $H_B$ 331. In order to provide the characteristic feature of the present invention to the portions corresponding to the rail head top portions, the hardness value of the portions corresponding to the head top portions was set to be 0.9 or less of the hardness (about $H_B$ 370) of the portions corresponding to the corner portions. A test piece whose top head portion was tempered after slack-quenching of the C-Mn steel in Table 1 was also prepared and subjected to the damage life test. This aims at a decrease in hardness of the head top portion by converting the head top portion structure into a spherical pearlitic structure.

Figure 9:
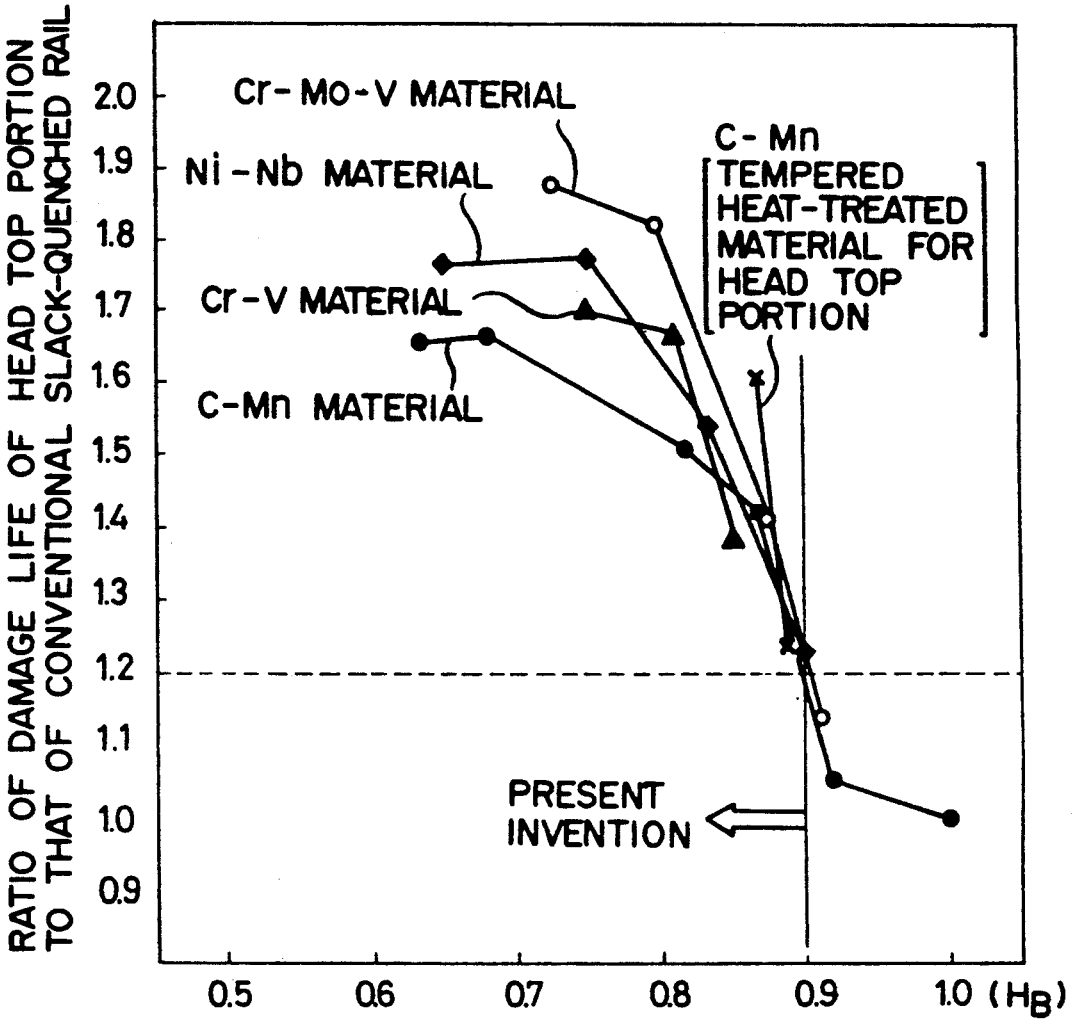
FIG. 9 is a graph showing the damage life cycles as a function of the hardness ratios of the rail test piece having different compositions or different heat-treatment methods.

Test results are shown in FIG. 9. As is apparent from FIG. 9, when hardness ratios of the rail head top portions to the rail corner portions of all the test pieces were set to be 0.9 or less, it was confirmed that the damage life was prolonged to 1.2 times or more (a maximum of 1.9 times).

Test pieces prepared by using the Cr-V, Cr-Mo-V, and Ni-Nb steel obtained by adding elements selected from Ni, Cr, Mo, Nb, and V had a longer damage life than that of the test pieces consisting of the C-Mn steel which did not contain the above additives. Therefore, it was confirmed that the damage life could be prolonged upon an addition of alloying elements such as Cr.

Rails obtained by slack-quenching the C-Mn steel (Table 1) to have a hardness distribution B in FIG. 7 were installed as rails of the present invention together with the conventional high-strength rails in a high-axle load railroad. A train traveled along the track in practice. The rail of the present invention had a good fitting property to the wheels in the initial period of their use. The damage rate of the rail head top surface upon passing of 250,000,000 tons was reduced to 1/6 as compared with the conventional rail. It was thus confirmed that the resistance to damage during a period except for the initial period of installation was also higher than that of the conventional rail.

Judging from these test results, in order to prolong the damage life, dispersion of the vertical stress acting from the wheels to the rail head top surfaces was found to be effective.

No prior arts are available to locally control the wear properties of the rail head in accordance with differences in positions of contact stresses acting from the wheels to the rail head. Along with widespread use of highly rigid tracks, the rail having an excellent anti-wear property and a high resistance to damage according to the present invention is expected to be effective to reduce railroad maintenance expenses.

According to the present invention, damage (e.g., head check) to the head top portion which is caused by an excessive contact pressure can be suppressed, and the rail life can be prolonged. For this reason, problems posed at the time of introduction of highly rigid tracks using concrete crossties at a sharp curve of a high-axles load railroad can be solved. The track maintenance expenses can be reduced, thus providing a great economical advantage.

What is claimed is:

1. A high-strength, damage-resistant rail consisting essentially of 0.60 to 0.85 wt. % of C, 0.1 to 1.0 wt. % of Si, 0.5 to 1.5 wt. % of Mn, not more than 0.035 wt. % of P, not more than 0.040 wt. % of S, and not more than 0.05 wt. % of Al, a balance being Fe and indispensable impurities, and comprising corner and head side portions having a Brinell hardness $H_B$ of 341 to 405 and a head top portion having a hardness which ranges from about 0.6 to 0.9 of the Brinell hardness of the corner and head side portions.

2. A high-strength, damage-resistant rail consisting essentially of 0.60 to 0.85 wt. % of C, 0.1 to 1.0 wt. % of Si, 0.5 to 1.5 wt. % of Mn, not more than 0.035 wt. % of P, not more than 0.040 wt. % of S, not more than 0.05 wt. % of Al, at least one element selected from the group consisting of 0.05 to 1.5 wt. % of Cr, 0.01 to 0.20 wt. % of Mo, 0.01 to 0.10 wt. % of V, 0.1 to 1.0 wt. % of Ni, and 0.005 to 0.050 wt. % of Nb, a balance being Fe and indispensable impurities, and comprising corner and head side portions having a Brinell hardness $H_B$ of 341 to 405 and a head top portion having a hardness which ranges from about 0.6 to 0.9 of the Brinell hardness of the corner and head side portions.

3. A method for manufacturing a high-strength damage-resistant rail, comprising the steps of: preparing a rail stock consisting essentially of about 0.6 to 0.85 wt. % of C, about 0.1 to 1 wt. % of Si, about 0.5 to 1.5 wt. % of Mn, not more than about 0.035 wt. % of P to prevent degradation of ductility, not more than about 0.04 wt. %. of S, not more than about 0.05 wt. % of Al to avoid degradation of the rail, and the balance being Fe and indispensable impurities by hot rolling such that cooling the head of the rail stock by supplying a coolant from nozzles of a cooling header to the head of the rail stock in a state where the head of the rail stock maintains an austenite temperature, said cooling step being carried out such that the cooling rate of the head top portion of the rail stock is lower than that of the head side portion of the rail stock by adjusting at least one of: the number of nozzles provided for the cooling header; the diameter of the nozzles; and the coolant supply pressure, wherein a rail comprising corner and head side portions having a Brinell hardness $H_B$ of 341 to 405 and a head top portion having a hardness which ranges from about 0.6 to 0.9 of the Brinell hardness of the corner and head side portions is obtained by said cooling step.

4. A method for manufacturing a high strength damage-resistant rail, comprising the steps of: preparing a rail stock consisting essentially of about 0.6 to 0.85 wt. % of C; about 0.1 to 1 wt. % of Si; about 0.5 to 1.5 wt. % of Mn; not more than about 0.035 wt. % of P to prevent degradation of ductility, not more than about 0.04 wt. % of S; not more than about 0.05 wt. % of Al to avoid degradation of the rail, at least one about 0.05 to 1.5 wt. % of Cr, about 0.01 to 0.20 wt. % of Mo, about 0.01 to 1.0 wt. % of V, about 0.1 to 1 wt. % of Ni, and 0.005 to 0.05 wt. % of Nb; and a balance being Fe and indispensable impurities by hot rolling such that cooling the head of the rail stock by supplying a coolant from nozzles of a cooling header to the head of the rail stock in a state where the head of the rail stock maintains an austenite temperature, said cooling step being carried out such that the cooling rate of the head top portion of the rail stock is lower than that of the head side portion of the rail stock by adjusting at least one of: the number of nozzles provided for the cooling header; the diameter of the nozzle; and the coolant supply pressure, wherein a rail comprising corner and head side portions having a Brinell hardness $H_B$ of 341 to 405 and a head top portion having a hardness which ranges from about 0.6 to 0.9 of the Brinell hardness of the corner and head side portions is obtained by said cooling step.

* * * * *